US008135155B2

(12) United States Patent
Lan et al.

(10) Patent No.: US 8,135,155 B2
(45) Date of Patent: Mar. 13, 2012

(54) ELECTRONIC DEVICE WITH INTERNAL ARRAY MICROPHONE AFFIXED TO REAR COVER OF DISPLAY

(75) Inventors: Yu-Hsi Lan, Hsinchu County (TW); Li-Te Wu, Taipei (TW); Yu-De Tsai, Taipei (TW)

(73) Assignee: Fortemedia, Inc., Sunnyvale, CA (US)

( * ) Notice: Subject to any disclaimer, the term of this patent is extended or adjusted under 35 U.S.C. 154(b) by 987 days.

(21) Appl. No.: 12/112,041

(22) Filed: Apr. 30, 2008

(65) Prior Publication Data

US 2009/0274333 A1 Nov. 5, 2009

(51) Int. Cl.
*H04R 9/04* (2006.01)

(52) U.S. Cl. ..... 381/333; 381/361; 381/368; 381/388

(58) Field of Classification Search ..... 381/306, 381/333, 355, 361, 368, 388; 361/679.23, 361/679.26, 679.55
See application file for complete search history.

(56) References Cited

U.S. PATENT DOCUMENTS

2008/0240471 A1* 10/2008 Chen et al. ..... 381/150
2009/0116658 A1* 5/2009 An et al. ..... 381/71.1

* cited by examiner

*Primary Examiner* — Minh-Loan T Tran
(74) *Attorney, Agent, or Firm* — Thomas|Kayden

(57) ABSTRACT

An electronic device includes a display, a plurality of chambers, and a microphone array. The display includes a front cover and a rear cover affixed to the front cover. The plurality of chambers is formed on the rear cover. The microphone array includes a plurality of microphones disposed in the chambers.

23 Claims, 14 Drawing Sheets

3

ELECTRONIC DEVICE WITH INTERNAL ARRAY MICROPHONE AFFIXED TO REAR COVER OF DISPLAY

BACKGROUND OF THE INVENTION

1. Field of the Invention

The invention relates to an electronic device with a display and array microphones, and more particularly to an electronic device with the array microphones affixed to the rear cover of the display.

2. Description of the Related Art

Referring to FIG. 1, a conventional notebook computer 1 includes a main body 11 and a display 12. A keyboard 111 is provided on the main body 11 for inputting data or commands. The display 12 is rotatably connected to the main body 11 for presentation of visual information.

The display 12 includes a front cover 121 and a rear cover 122 affixed to the front cover 121. Referring to FIGS. 2A and 2B, a liquid crystal module (LCM) 15 is affixed to the rear cover 122. A plurality of microphones 13 is affixed to the front cover 121 on which a plurality of acoustic openings 1223 is provided corresponding to the microphones 13. When in operation, the microphones 33 are capable of receiving external sound (generally from the front of the display 32) via the acoustic openings 3223 and sending sound signals to the main body 11 through an electrical wire 19, connectors 17 and 18, and the LCM 15.

During the process of assembling the front cover 121 and the rear cover 122 in factories, however, the electrical wire 19 requires additional care when being assembled. Therefore, the assembly process is not so efficient.

Furthermore, the microphones 33 are sometimes required to operate even if the main body 31 is covered by the display 32 which is not in use. In this situation, however, the microphones 33 of the notebook computer 1 cannot receive external sound because the acoustic openings 3223 are hidden.

BRIEF SUMMARY OF THE INVENTION

The invention provides an electronic device (e.g. a notebook computer) to avoid the described problems. The electronic device in accordance with an exemplary embodiment of the invention includes a display, a plurality of chambers, and a microphone array. The display includes a front cover and a rear cover affixed to the front cover. The plurality of chambers is formed on the rear cover. The microphone array includes a plurality of microphones disposed in the chambers.

In another exemplary embodiment, the rear cover has a plurality of acoustic openings through which the microphones receive external sound.

In yet another exemplary embodiment, the electronic device further includes a main body to which the display is rotatably connected, wherein the acoustic openings are exposed when the display is rotated to cover the main body.

In another exemplary embodiment, the rear cover further has a planar board and a plurality of flanges extending from the planar body, and the acoustic openings are formed on the planar board.

In yet another exemplary embodiment, the acoustic openings are arranged in a line.

In another exemplary embodiment, the acoustic openings are arranged in an L shape.

In yet another exemplary embodiment, the rear cover further has a planar board and a plurality of flanges extending from the planar board, and the acoustic openings are formed on the flanges.

In another exemplary embodiment, the acoustic openings are arranged in a line.

In yet another exemplary embodiment, the acoustic openings are arranged in an L shape.

In another exemplary embodiment, the electronic device further includes a plurality of flexible holders disposed in the chambers, wherein the microphones are disposed in the flexible holders.

In yet another exemplary embodiment, the electronic device is a notebook computer.

In another exemplary embodiment, the electronic device is a cell phone.

In yet another exemplary embodiment, the electronic device is an ultra mobile personal computer.

In another exemplary embodiment, the electronic device includes a display, a plurality of acoustic openings, and a microphone array. The display includes a front cover and a rear cover affixed to the front cover. The plurality of acoustic openings is formed on the rear cover. The microphone array includes a plurality of microphones disposed in the display, receiving external sound through the acoustic openings.

In yet another exemplary embodiment, the electronic device further includes a main body to which the display is rotatably connected, wherein the acoustic openings are exposed when the display is rotated to cover the main body.

In another exemplary embodiment, the rear cover further has a planar board and a plurality of flanges extending from the planar body, and the acoustic openings are formed on the planar board.

In yet another exemplary embodiment, the acoustic openings are arranged in a line.

In another exemplary embodiment, the acoustic openings are arranged in an L shape.

In yet another exemplary embodiment, the rear cover further has a planar board and a plurality of flanges extending from the planar board, and the acoustic openings are formed on the flanges.

In another exemplary embodiment, the acoustic openings are arranged in a line.

In yet another exemplary embodiment, the electronic device is a notebook computer.

In another exemplary embodiment, the electronic device is a cell phone.

In yet another exemplary embodiment, the electronic device is an ultra mobile personal computer.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

While a notebook computer is utilized for purposes of illustration, it is understood that the invention is equally applicable to a variety of electronic devices including cell phones, ultra mobile personal computers (UMPCs), and others.

Figure 3:
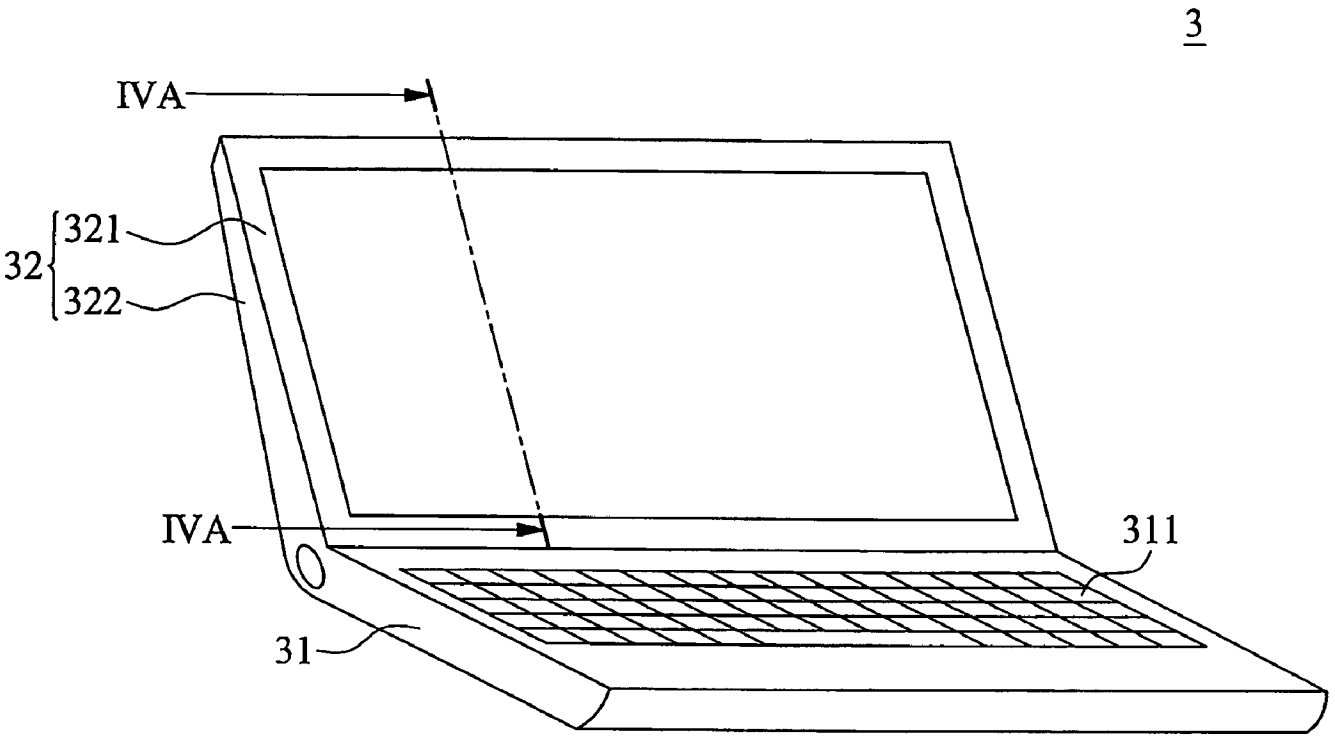
FIG. 3 is a perspective diagram of a notebook computer in accordance with a first embodiment of the invention.

Referring to FIG. 3, a notebook computer 3 of a first embodiment of the invention includes a main body 31 and a display 32. A keyboard 311 is provided on the main body 31 for inputting data or commands. The display 32 is rotatably connected to the main body 31 for presentation of visual information.

Figure 1:
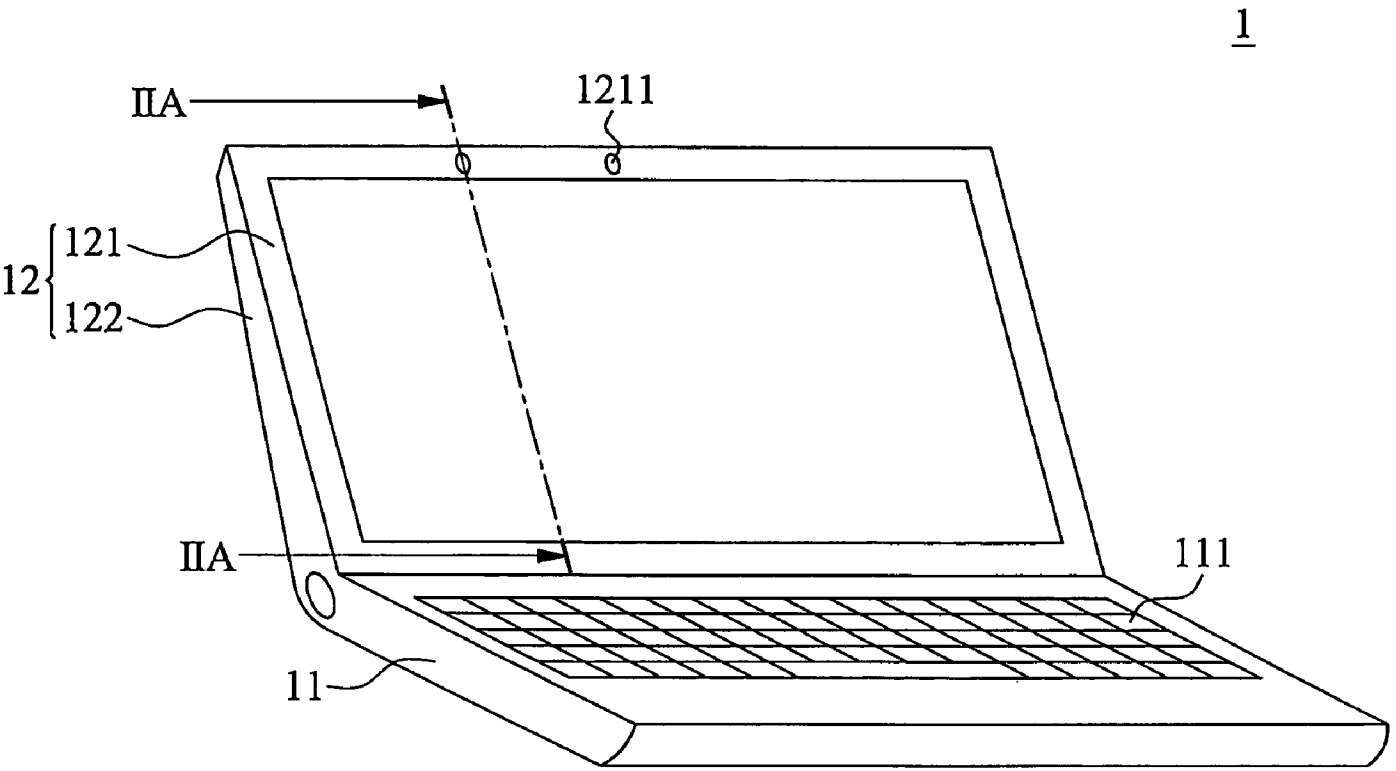
Fig. 1(PRIOR ART)
FIG. 1 is a perspective diagram of a conventional notebook computer.
Figure 2B:
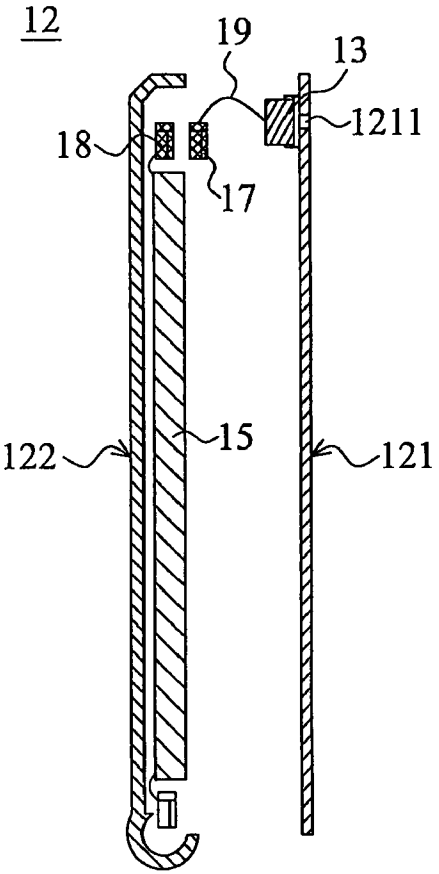
Fig.2B(PRIOR ART)
FIG. 2B is an exploded view of the display of the notebook computer of FIG. 2A.
Figure 2A:
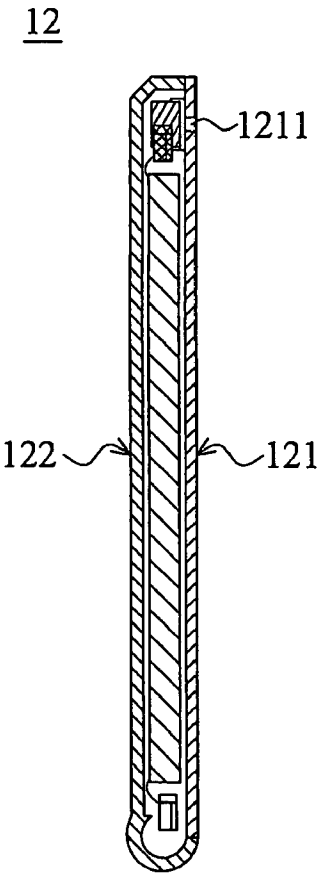
Fig.2A(PRIOR ART)
FIG. 2A depicts a IIA-IIA section of the display of the notebook computer of FIG. 1.
Figure 4B:
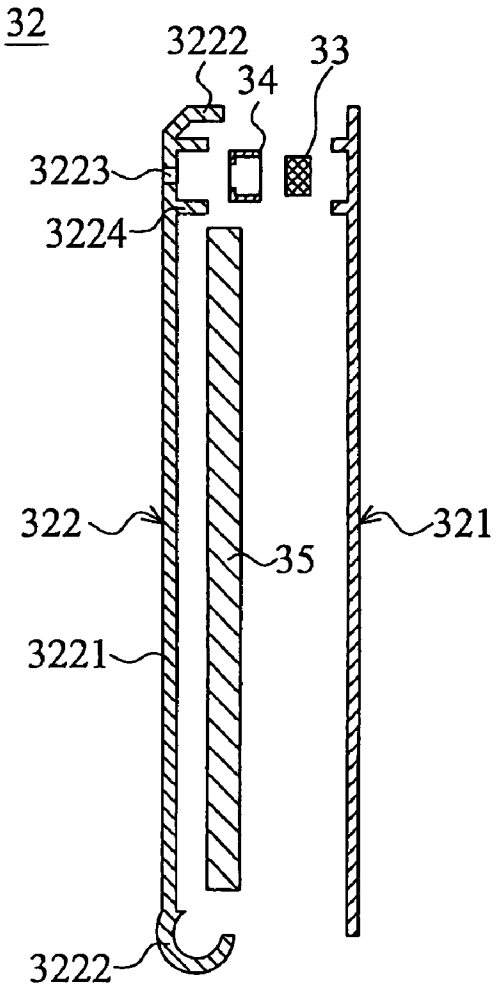
FIG. 4B is an exploded view of the display of the notebook computer of FIG. 4A.
Figure 4A:
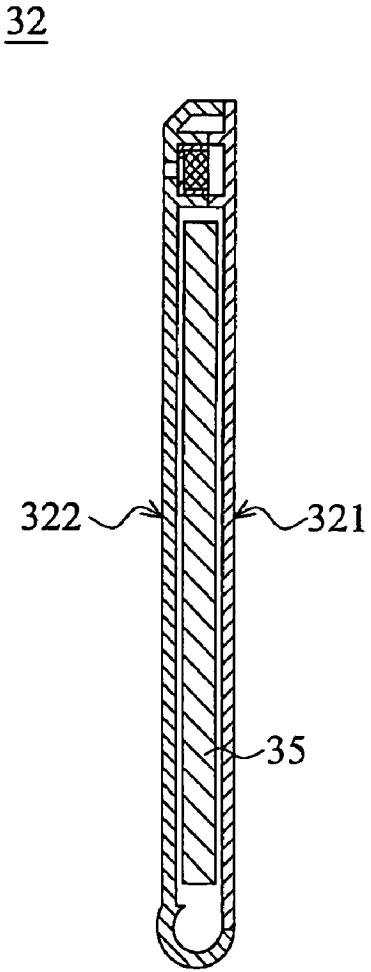
FIG. 4A depicts a IVA-IVA section of the display of the notebook computer of FIG. 3.

The display 32 includes a front cover 321 and a rear cover 322 affixed to the front cover 321. Referring to FIGS. 4A and 4B, a liquid crystal module (LCM) 35 is affixed to the rear cover 322. A plurality of chambers 3224 is formed on the rear cover 322. A plurality of microphones 33 is respectively fitted into flexible holders 34 and disposed in the chambers 3224. The flexible holders 34 not only protect the microphones 33 from vibrations but also sound leakage. Because the microphones 33 are affixed to the rear cover 322 rather than the front cover 321, the electrical wire 19 of FIG. 2B running from the front cover to the rear cover can be omitted, thus improving assembly efficiency of the display 32.

The rear cover 322 includes a planar board 3221 and a plurality of flanges 3222 extending from the planar board 3221. In the first embodiment, a plurality of acoustic openings 3223 is provided on the planar board 3221 of the rear cover 322, corresponding to the microphones 33. When in operation, the microphones 33 in the display 32 are capable of receiving external sound through the acoustic openings 3223.

Figure 5:
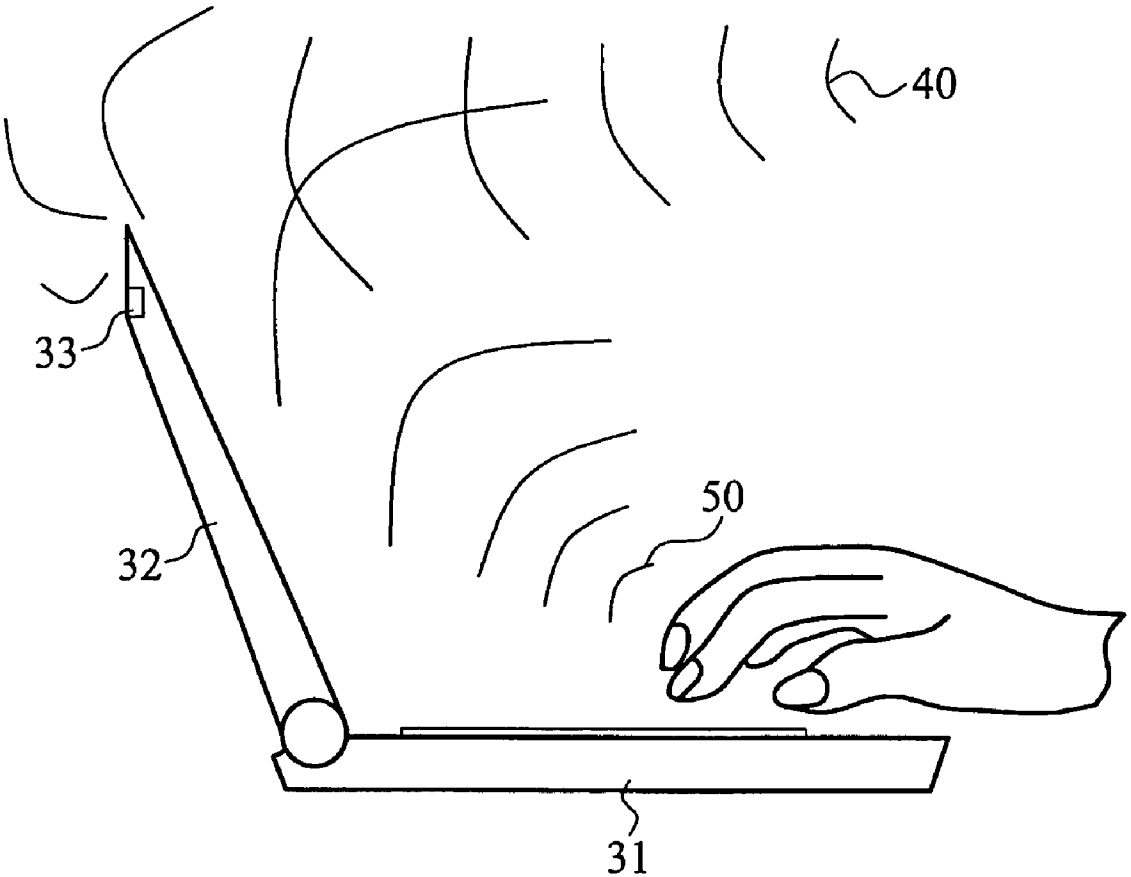
FIG. 5 depicts the operation of the notebook computer of FIG. 3, with the display opened.

As shown in FIG. 5, the plurality of microphones 33 constitutes a microphone array which is capable of clearly receiving sound 40 from the user in front of the notebook computer 3 due to diffraction of the sound waves. The microphone array may also receive the noise 50 from the keyboard, the hard disk, and the dissipating fan due to diffraction. However, the noise 50 requires a longer travel distance to the microphone array than the sound 40. Thus, the noise 50 decays more than the sound 40 when arriving at the microphone array.

Figure 6:
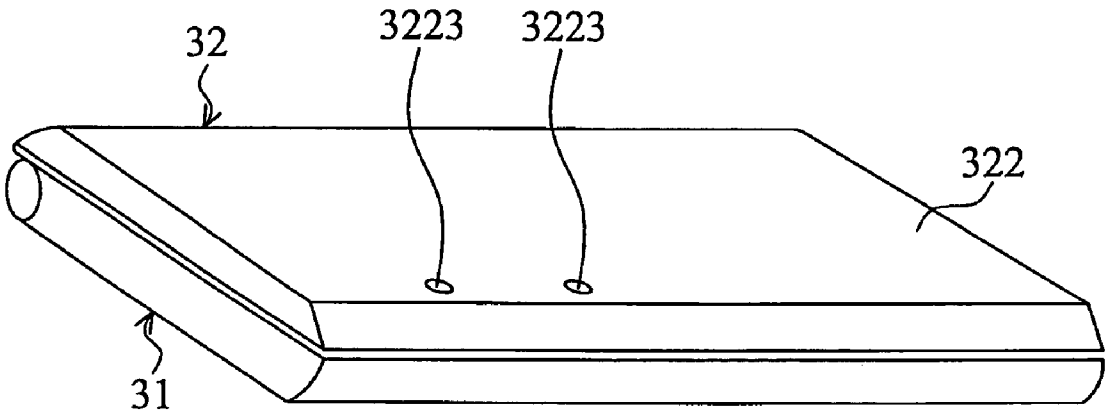
FIG. 6 depicts the operation of the notebook computer of FIG. 3, with the display closed.

Referring to FIG. 6, when the display 32 is rotated to cover the main body 31, the acoustic openings 3223 are exposed so that the microphones 33 in the display 32 can still receive external sound through the acoustic openings 3223.

Figure 7:
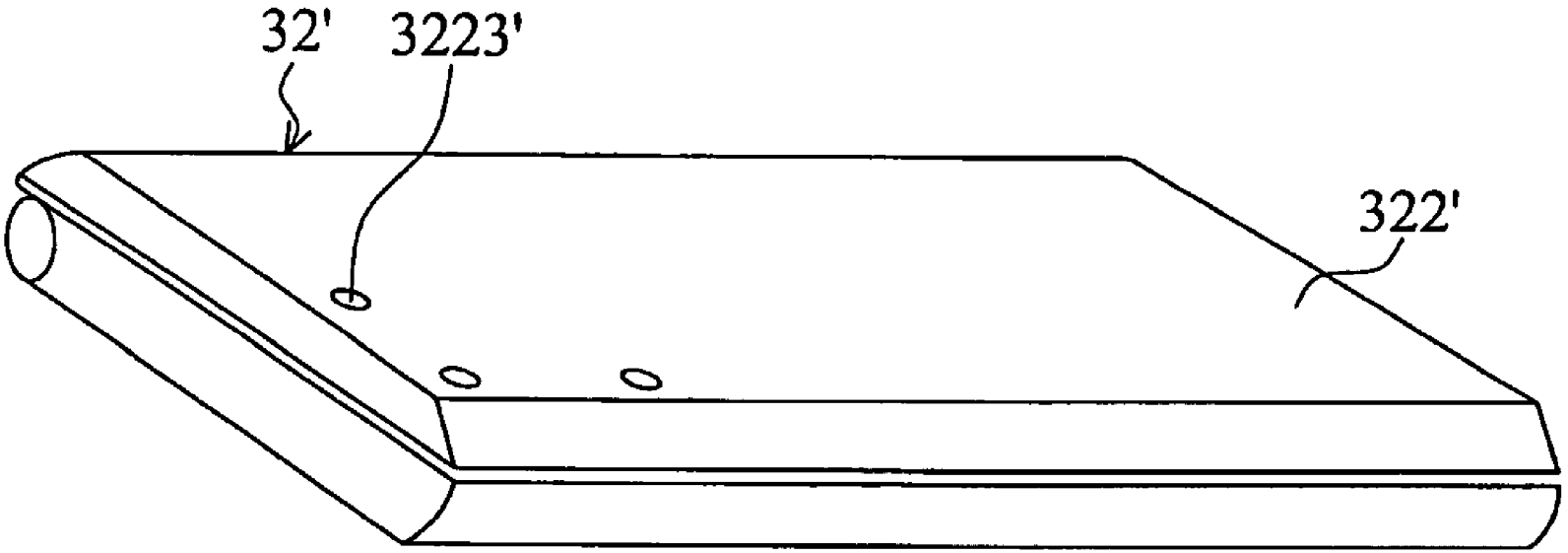
FIG. 7 depicts a modified arrangement of the acoustic openings of the display of FIG. 6.
Figure 8:
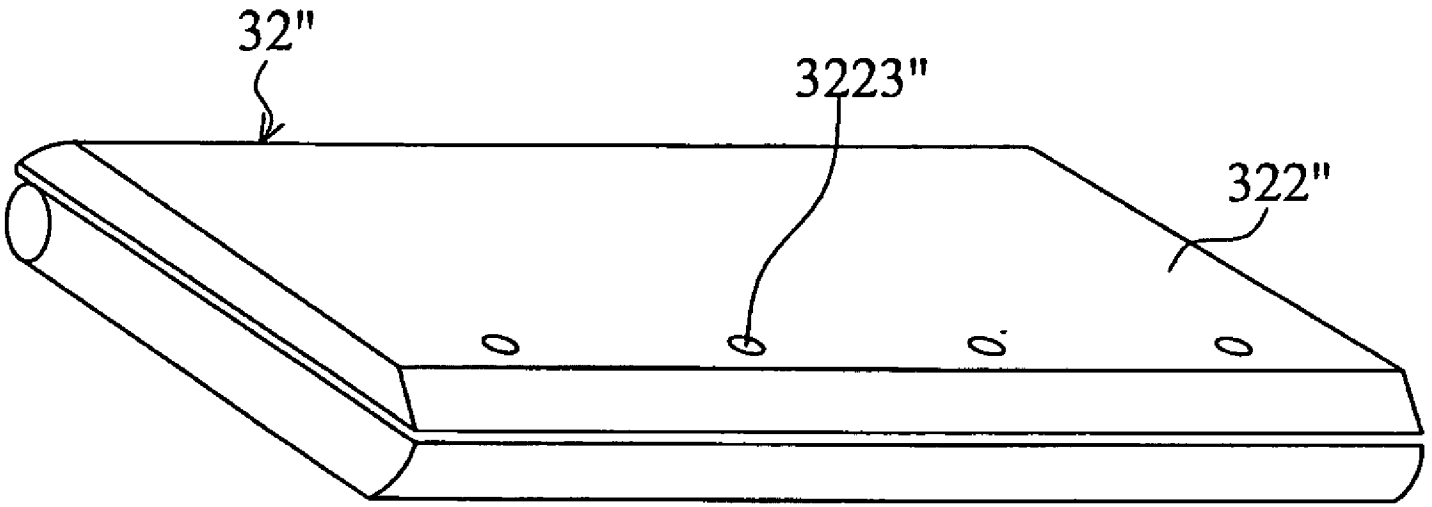
FIG. 8 depicts another modified arrangement of the acoustic openings of the display of FIG. 6.

The arrangement and number of acoustic openings 3223 can be implemented in different ways. As shown in FIG. 6, for example, two acoustic openings 3223 are arranged in a line on the rear cover 322 of the display 32. As shown in FIG. 7, for another example, three acoustic openings 3223' are arranged in an L shape on the rear cover 322' of the display 32'. As shown in FIG. 8, for yet another example, four acoustic openings 3223" are arranged in a line on the rear cover 322" of the display 32".

Figure 9:
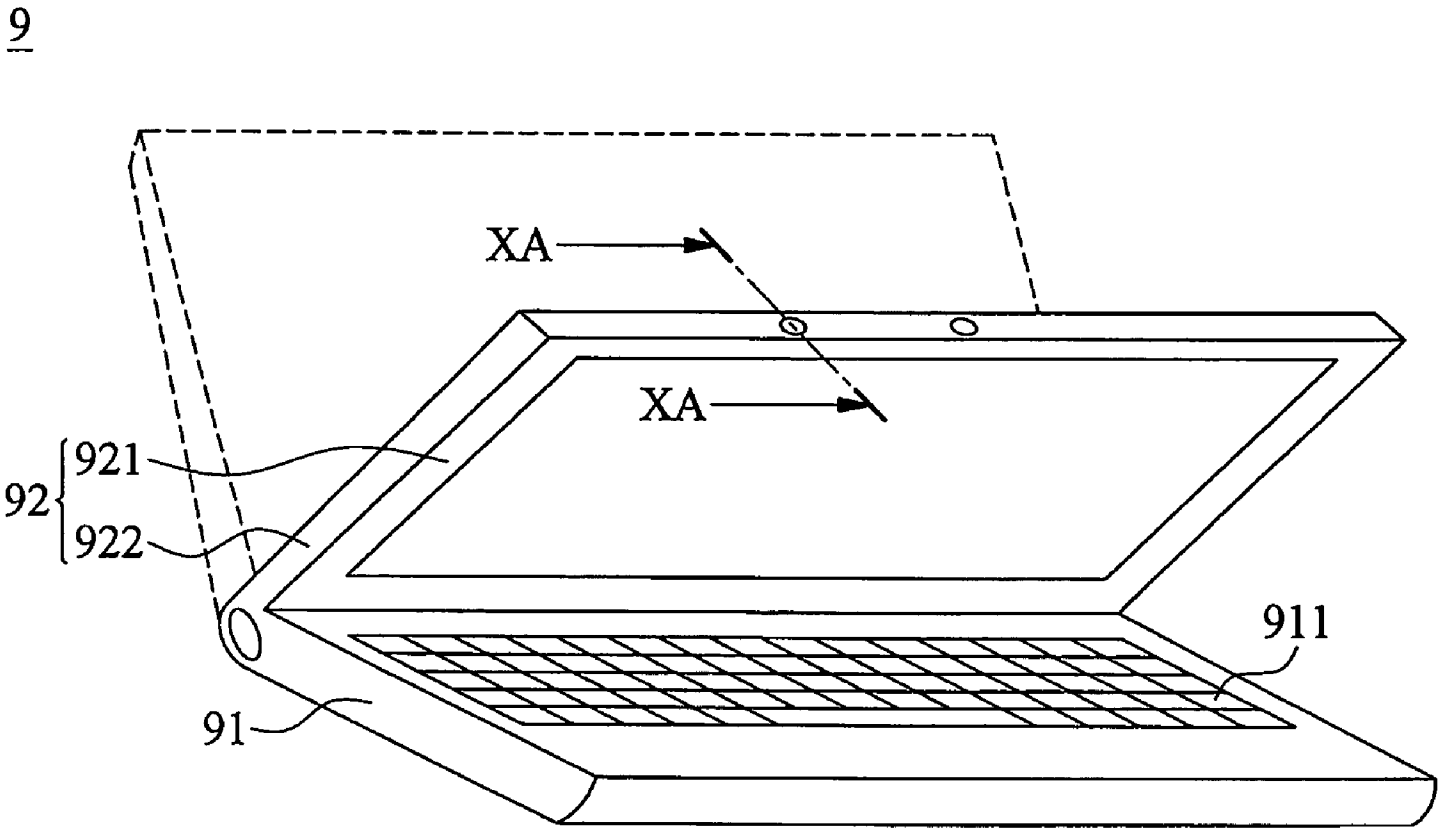
FIG. 9 is a perspective diagram of a notebook computer in accordance with a second embodiment of the invention.

Referring to FIG. 9, a notebook computer 9 of a second embodiment of the invention includes a main body 91 and a display 92. A keyboard 911 is provided on the main body 91 for inputting data or commands. The display 92 is rotatably connected to the main body 91 for presentation of visual information.

Figure 10B:
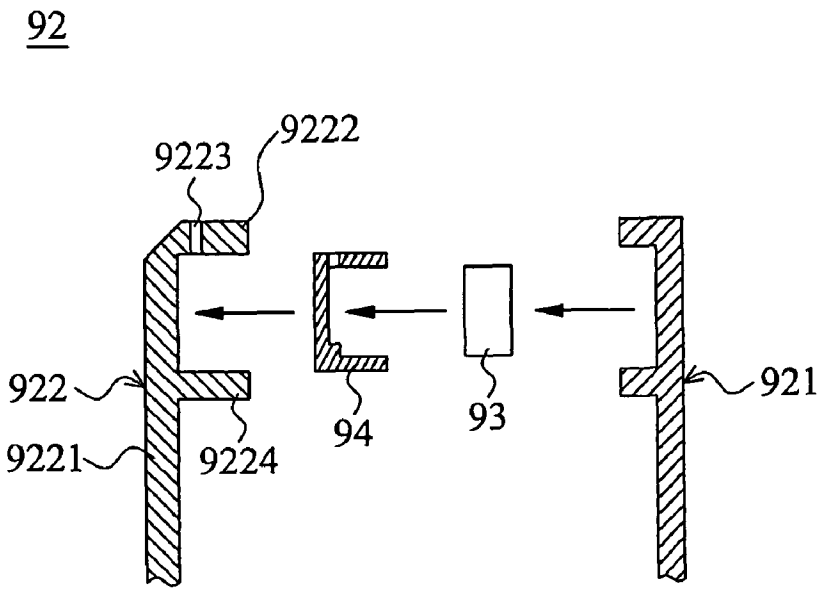
FIG. 10B is an exploded view of the display of the notebook computer of FIG. 10A.
Figure 10A:
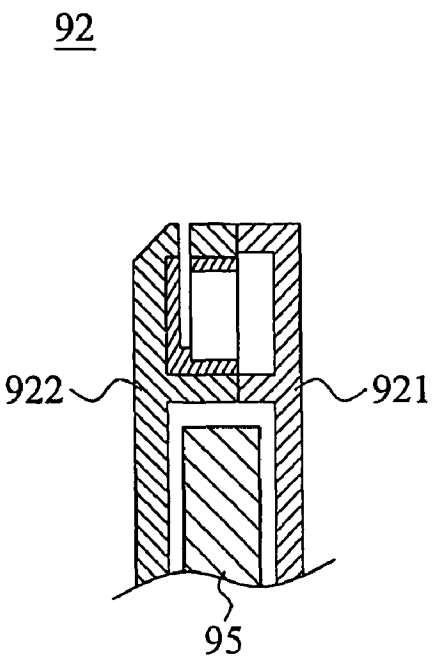
FIG. 10A depicts an XA-XA section of the display of the notebook computer of FIG. 9.

The display 92 includes a front cover 921 and a rear cover 922 affixed to the front cover 921. Referring to FIGS. 10A and 10B, a liquid crystal module (LCM) 95 is affixed to the rear cover 922. A plurality of chambers 9224 is formed on the rear cover 922. A plurality of microphones 93 is respectively fitted into flexible holders 94 and disposed in the chambers 9224. The flexible holders 94 not only protect the microphones 93 from vibrations but also avoid sound leakage. Because the microphones 93 are affixed to the rear cover 922 rather than the front cover 921, the electrical wire 19 of FIG. 2B running from the front cover to the rear cover can be omitted, thus improving assembly efficiency of the display 92.

The rear cover 922 includes a planar board 9221 and a plurality of flanges 9222 extending from the planar board 9221. In the second embodiment, a plurality of acoustic openings 9223 is provided on the flanges 9222 of the rear cover 922, corresponding to the microphones 93. When in operation, the microphones 93 in the display 92 are capable of receiving external sound through the acoustic openings 9223.

Figure 11:
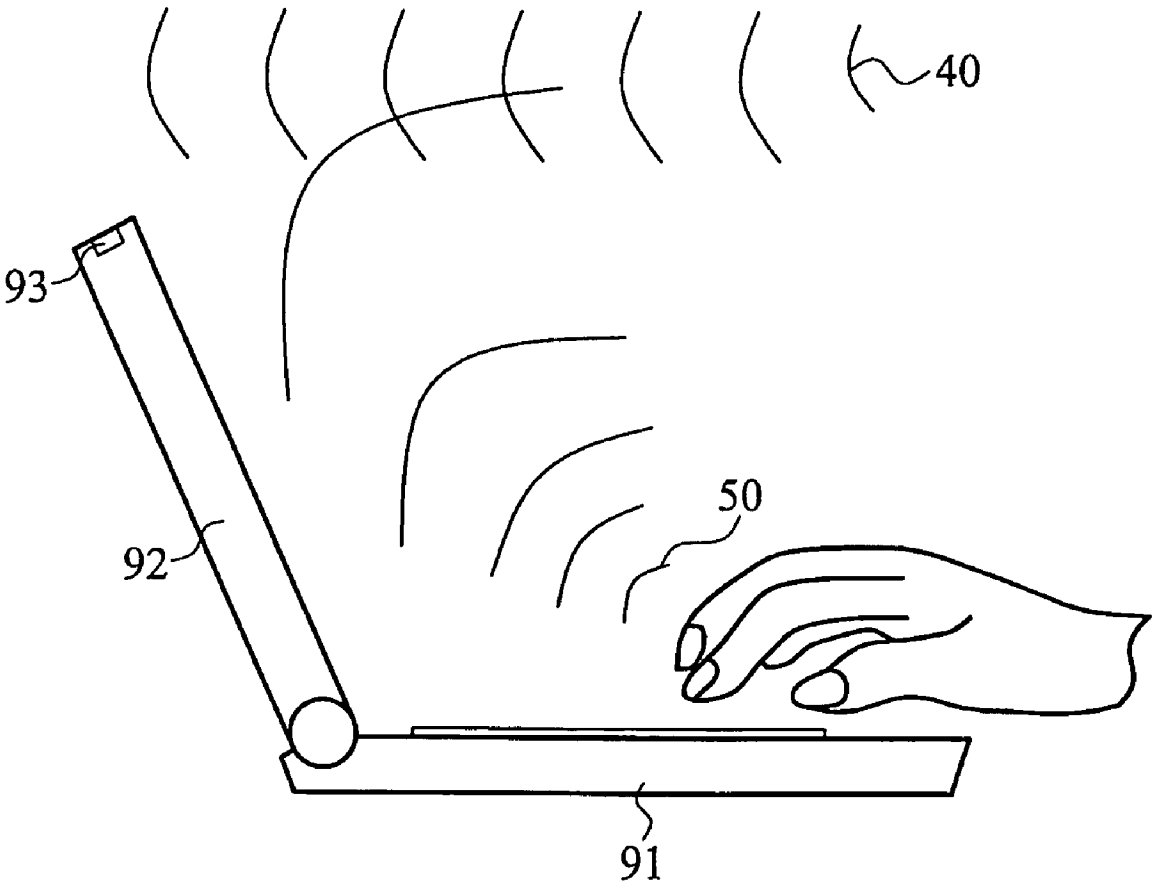
FIG. 11 depicts the operation of the notebook computer of FIG. 9, with the display opened.

As shown in FIG. 11, the plurality of microphones 93 constitutes a microphone array which is capable of clearly receiving sound 40 from the user in front of the notebook computer 9 due to diffraction of the sound waves. The microphone array may also receive the noise 50 from the keyboard, the hard disk, and the dissipating fan due to diffraction. However, the noise 50 requires a longer travel distance to the microphone array than the sound 40. Thus, the noise 50 decays more than the sound 40 when arriving at the microphone array.

Figure 12:
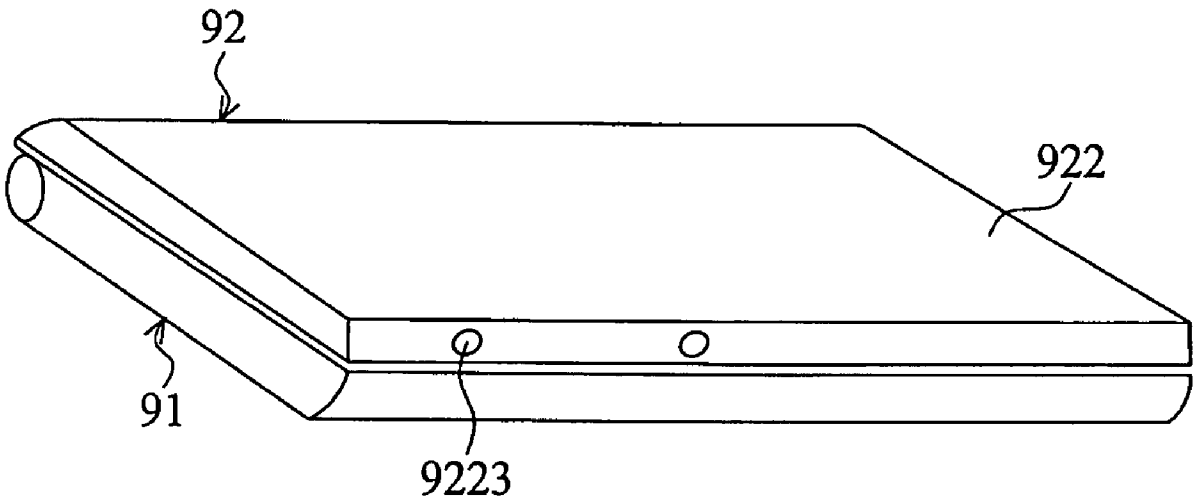
FIG. 12 depicts the operation of the notebook computer of FIG. 9, with the display closed.

Referring to FIG. 12, when the display 92 is rotated to cover the main body 91, the acoustic openings 9223 are exposed so that the microphones 93 in the display 92 can still receive external sound through the acoustic openings 9223.

Figure 13:
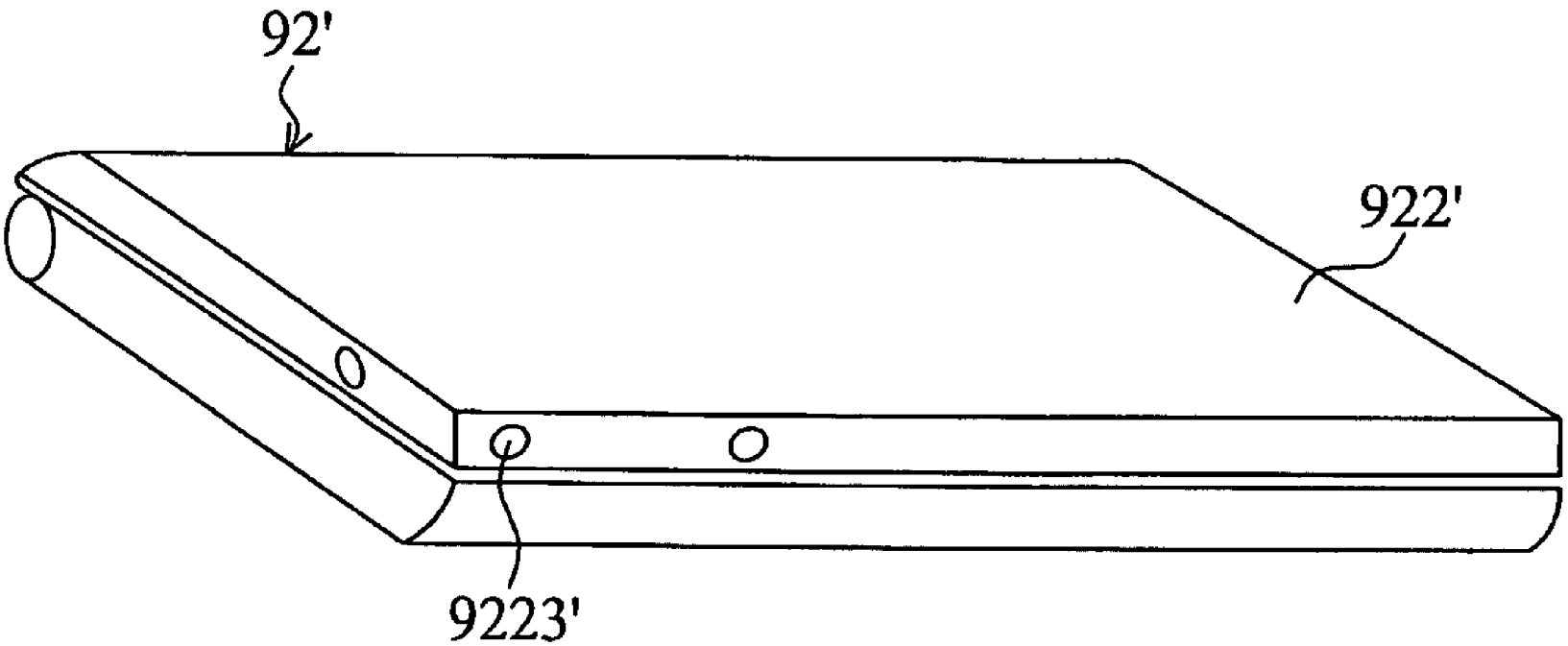
FIG. 13 depicts a modified arrangement of the acoustic openings of the display of FIG. 12.
Figure 14:
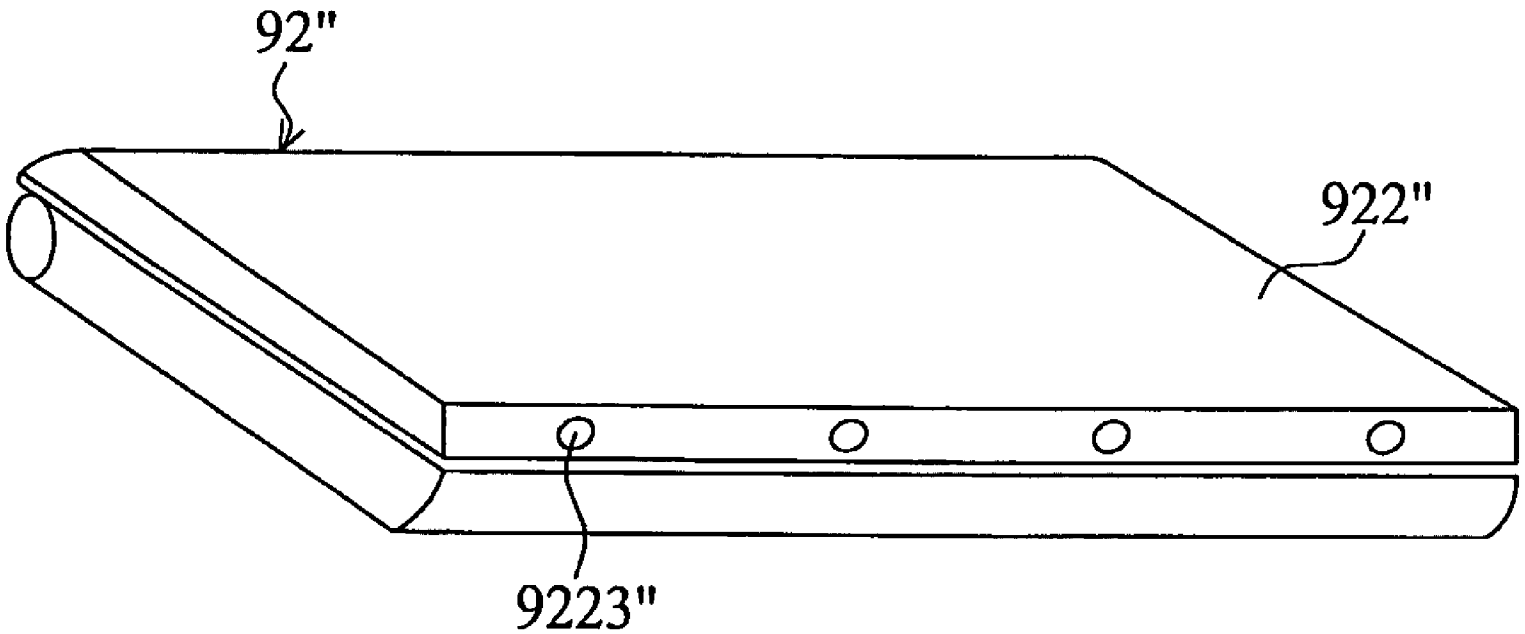
FIG. 14 depicts another modified arrangement of the acoustic openings of the display of FIG. 12.

The arrangement and number of acoustic openings 9223 can be implemented in different ways. As shown in FIG. 12, for example, two acoustic openings 9223 are arranged in a line on the rear cover 922 of the display 92. As shown in FIG. 13, for another example, three acoustic openings 9223' are arranged in an L shape on the rear cover 922' of the display 92'. As shown in FIG. 14, for yet another example, four acoustic openings 9223" are arranged in a line on the rear cover 922" of the display 92".

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a display including a front cover and a rear cover affixed to the front cover;

a plurality of chambers formed on the rear cover; and a microphone array including a plurality of microphones disposed in the chambers;

wherein the rear cover has a plurality of acoustic openings through which the microphones receives external sound.

2. The electronic device as claimed in claim 1, further comprising a main body to which the display is rotatably connected, wherein the acoustic openings are exposed when the display is rotated to cover the main body.

3. The electronic device as claimed in claim 1, wherein the rear cover further has a planar board and a plurality of flanges extending from the planar body, and the acoustic openings are formed on the planar board.

4. The electronic device as claimed in claim 3, wherein the acoustic openings are arranged in a line.

5. The electronic device as claimed in claim 3, wherein the acoustic openings are arranged in an L shape.

6. The electronic device as claimed in claim 1, wherein the rear cover further has a planar board and a plurality of flanges extending from the planar board, and the acoustic openings are formed on the flanges.

7. The electronic device as claimed in claim 6, wherein the acoustic openings are arranged in a line.

8. The electronic device as claimed in claim 6, wherein the acoustic openings are arranged in an L shape.

9. The electronic device as claimed in claim 1, further comprising a plurality of flexible holders disposed in the chambers, wherein the microphones are disposed in the flexible holders.

10. The electronic device as claimed in claim 1, wherein the electronic device is a notebook computer.

11. The electronic device as claimed in claim 1, wherein the electronic device is a cell phone.

12. The electronic device as claimed in claim 1, wherein the electronic device is an ultra mobile personal computer.

13. An electronic device, comprising:

a display including a front cover and a rear cover affixed to the front cover;

a plurality of acoustic openings formed on the rear cover; and a microphone array including a plurality of microphones disposed in the display, receiving external sound through the acoustic openings.

14. The electronic device as claimed in claim 13, further comprising a main body to which the display is rotatably connected, wherein the acoustic openings are exposed when the display is rotated to cover the main body.

15. The electronic device as claimed in claim 13, wherein the rear cover further has a planar board and a plurality of flanges extending from the planar body, and the acoustic openings are formed on the planar board.

16. The electronic device as claimed in claim 15, wherein the acoustic openings are arranged in a line.

17. The electronic device as claimed in claim 15, wherein the acoustic openings are arranged in an L shape.

18. The electronic device as claimed in claim 13, wherein the rear cover further has a planar board and a plurality of flanges extending from the planar board, and the acoustic openings are formed on the flanges.

19. The electronic device as claimed in claim 18, wherein the acoustic openings are arranged in a line.

20. The electronic device as claimed in claim 18, wherein the acoustic openings are arranged in an L shape.

21. The electronic device as claimed in claim 13, wherein the electronic device is a notebook computer.

22. The electronic device as claimed in claim 13, wherein the electronic device is a cell phone.

23. The electronic device as claimed in claim 13, wherein the electronic device is an ultra mobile personal computer.

* * * * *